United States Patent [19]

Thomas

[11] 4,253,203

[45] Mar. 3, 1981

[54] FOLDING TRANSFER BENCH

[75] Inventor: Morton I. Thomas, Nyack, N.Y.

[73] Assignee: Temco Products, Inc., Passaic, N.J.

[21] Appl. No.: 72,009

[22] Filed: Sep. 4, 1979

[51] Int. Cl.[3] ..... A47K 3/00

[52] U.S. Cl. ..... 4/559; 4/560; 4/604; 4/611; 4/612

[58] Field of Search ..... 4/185 R, 185 S, 185 L, 4/576, 610, 611, 596, 604, 612, 555, 561, 560

[56] References Cited

U.S. PATENT DOCUMENTS

| | | | |
|---|---|---|---|
| 2,237,076 | 4/1941 | Kenney et al. | 4/185 S |
| 3,090,969 | 5/1963 | Maling | 4/185 S |
| 3,703,733 | 11/1972 | McLoughlin | 4/185 L |
| 4,091,479 | 5/1978 | Hancock | 4/185 S |
| 4,150,445 | 4/1979 | Bailey | 4/185 L |
| 4,166,297 | 9/1979 | Saleeby | 4/185 S |

*Primary Examiner*—Henry K. Artis
*Attorney, Agent, or Firm*—Richard C. Woodbridge

[57] ABSTRACT

The chair of a transfer bench includes hooks for selectively engaging and disengaging the seat from supporting tracks. Rollers attached to the chair allow the chair to move on the tracks. The bench portion comprises a pair of parallel tubular tracks supported by legs. A pair of safety hooks attached to the underside of the chair loosely engage the tracks and keep the chair from tipping. The legs are normally locked in the open position. For storage purposes it is possible to unlock the legs and fold them up against the track unit. A genital guard is provided on the underside of the seat to insure patient comfort and protection. The apparatus allows the user to transfer into and out of a bathtub or shower with a minimum of inconvenience and a maximum of security.

12 Claims, 9 Drawing Figures

FOLDING TRANSFER BENCH

BACKGROUND OF THE INVENTION

1. Field of the Invention

This invention concerns a roller mounted seat supported by a dual track bench that is used by a patient to transfer into or out of a shower or bathtub area.

2. Description of the Prior Art

A typical prior art bench is illustrated in FIG. 1. It includes a flat, water impervious seat, two pairs of legs which straddle the edge of the bathtub, and a back. There are several drawbacks to the prior art device illustrated in FIG. 1. In general it is difficult for some patients to slide across the seat due to the friction of the seat itself and the weakness of the patient. In order to keep water from running off the seat and out of the tub it is frequently necessary to make the inside leg slightly shorter than the outside legs. The resulting incline can be hazardous to patients with limited muscular abilities. It is not possible to draw a shower curtain across the bench when in use because the seat interferes with the normal path of the curtain. It should also be mentioned that it is difficult for a patient using a solid seat to clean himself from underneath. Moreover, many male patients experience difficulty with the prior art design because it is anatomically unsuited for the genital region. Finally, the prior art design is generally uncomfortable because of the hard unyielding nature of the material used.

Also of possible relevance is the Shower Trolley which comprises a wheeled seat supported by a rigid bench for use in a tub or shower stall. The shower trolley is available through Sonneville Associates, 8604 Oakwood Drive, Crystal Lake, Illinois 60014.

SUMMARY OF THE INVENTION

Briefly described the invention comprises a collapsible bench which cooperates with a roller mounted chair so that a patient can slide into and out of a bathtub area. The bench portion includes a pair of tubular parallel tracks mounted on a pair of collapsible U-shaped leg sections. A bracket connected to each of the leg sections is employed to lock the legs in the open position. The bench can be stored by disengaging the locking bracket and folding the legs up against the tracks.

The chair is mounted on four hour-glass shaped plastic rollers. A pair of rollers engage each of the two tubular tracks respectively. Two spring-loaded hooks are attached to the underside of the chair and loosely engage the tracks so as to prevent the chair from tipping. It is possible to turn the chair 180° by disengaging the hooks, rotating the chair apparatus and re-engaging the hooks so that the chair is facing in the opposite direction. The chair includes a padded seat having an access aperture therein, a back, and a pair of arms.

A fabric genital guard is connected across part of the underside of the seat aperture in order to protect males from genital damage as the chair passes over the edge of the bathtub. The genital guard is connected by releasable fasteners so that the flap can be disengaged and the patient can clean himself from underneath.

These and other features of the invention will be more fully understood with reference to the following drawings and detailed description of the preferred embodiment.

DETAILED DESCRIPTION OF THE PREFERRED EMBODIMENT

During the course of this description like numbers will be used to indicate like elements according to the different figures which illustrate the invention.

Figure 1:
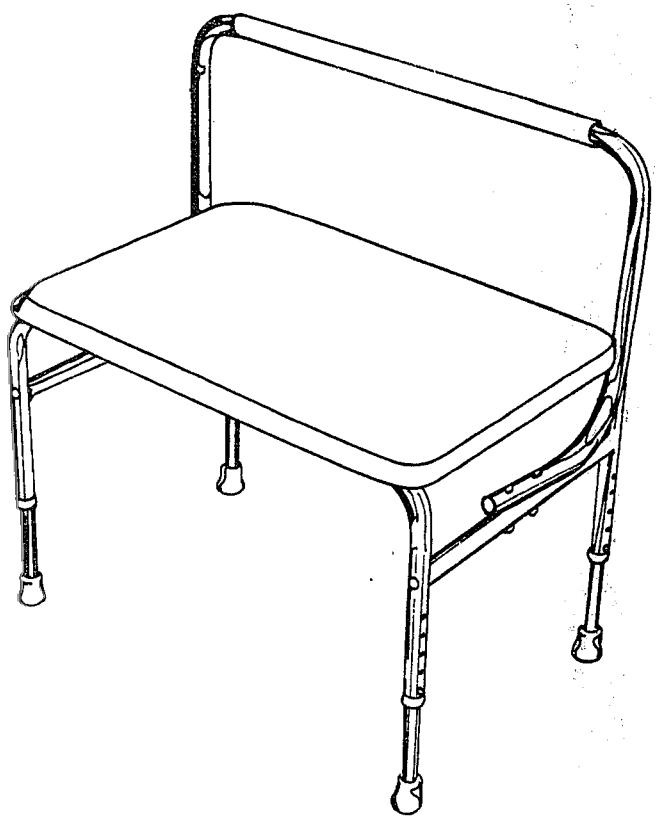
Fig. 1. PRIOR ART
FIG. 1 is a perspective view of a typical prior art bench.
Figure 2A:
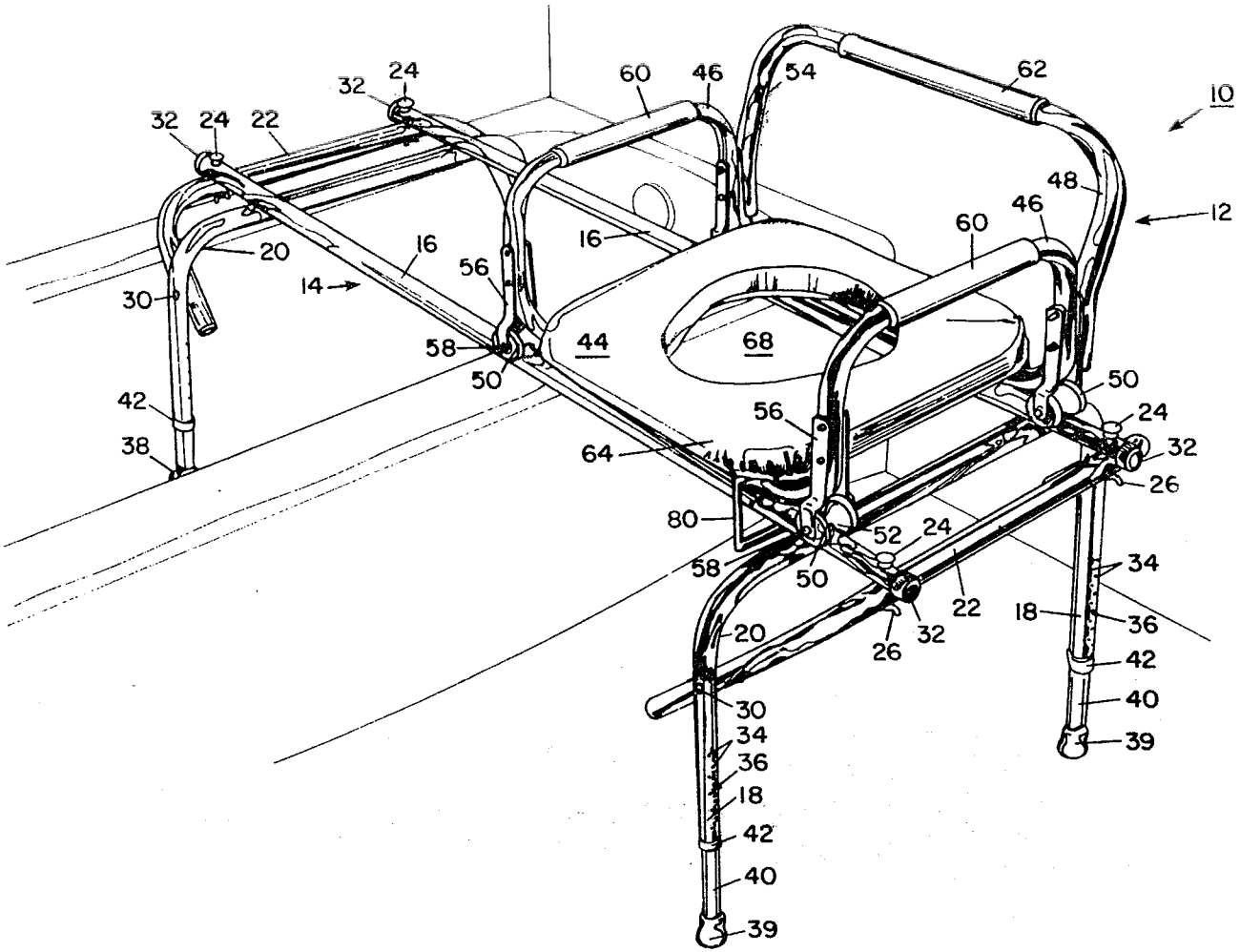
FIG. 2A is a perspective view of the preferred embodiment of the invention showing it in the context of a bathtub with the chair located outside of the bathtub area.
Figure 2B:
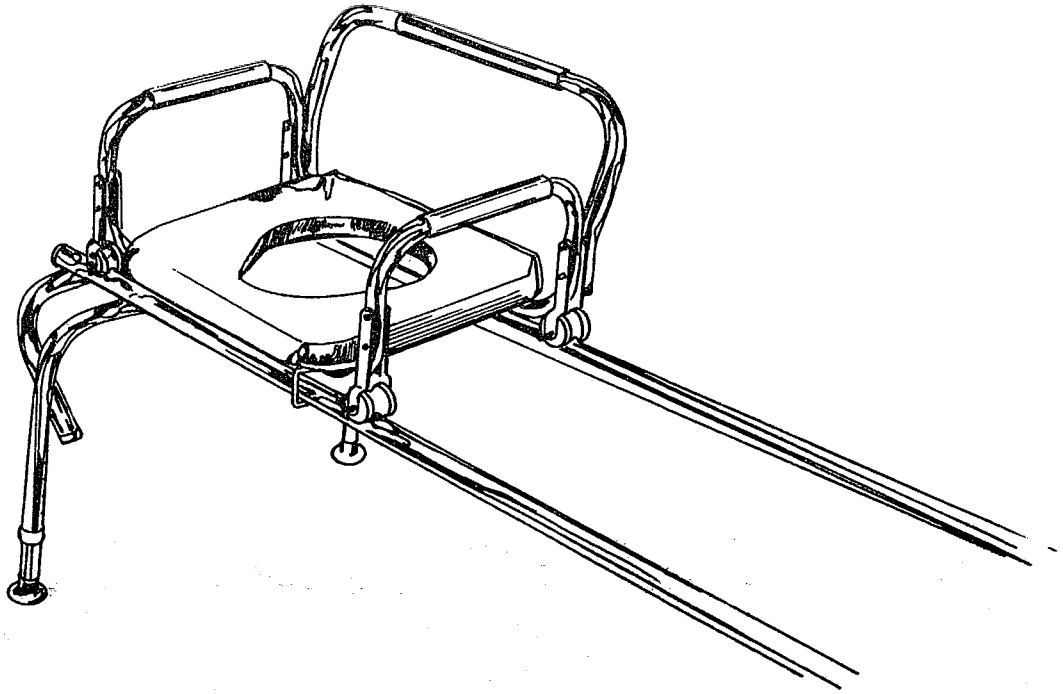
FIG. 2B is a perspective view of the invention illustrated in FIG. 2A with the chair transferred to the inside of the bathtub.

A transfer bench 10 according to the preferred embodiment of the invention is illustrated in FIGS. 2A–6. As shown in FIG. 2A a chair 12 is supported by and rolls over a collapsible bench 14. Bench 14 includes a pair of tubular horizontal tracks 16 supported by four vertical legs 18. The four vertical legs 18 are included in two tubular U-shaped elements 20 attached at opposite ends of the tubular track bed 16. Each of the two leg elements 20 is straddled by a U-shaped brace 22 which is connected at opposite ends thereof across the leg sections 18 of each of the U-shaped leg elements 20. Locking braces 22 can be fastened to the ends of tubular tracks 16 by bolts 24 which pass through apertures in the tracks 16 and locking brace 22 so that they may be secured together by wing nuts 26. A small indentation 25 in the tracks 16 receives brace 22 of the connection points.

Leg elements 20 can be swivelly connected to track 16 by trunion-like brackets 28. Similarly a rivet or pin 30 can be used to rotatably connected locking brace 22 to leg element 20. The ends of tubular tracks 16 are covered by suitable protective plastic caps 32. The length of the legs 18, and therefore the height of the chair 12 can be readily adjusted. Each leg 18 includes a plurality of height adjustment holes 34 which may be selectively engaged with a locking button 36. Holes 34 are lined up one inch apart in two rows and staggered by ½" so that height adjustments of ½" can be obtained. One pair of Legs 18 include a rubber suction foot 38 attached to a lower tubular leg section 40 which telescopes into the U-shaped leg section 20. Rubber feet 38 are for use on the bathtub side of the bench. Another set of non-suction rubber feet 39 are used on the legs 18 on the outside of the bathtub. A suitable vibration damping collar 42 is located at each end of the U-shaped leg element 20. Because each of the legs 18 is independently adjustable it is possible to easily accomodate the bench for any bathtub or irregular surface.

Figure 6:
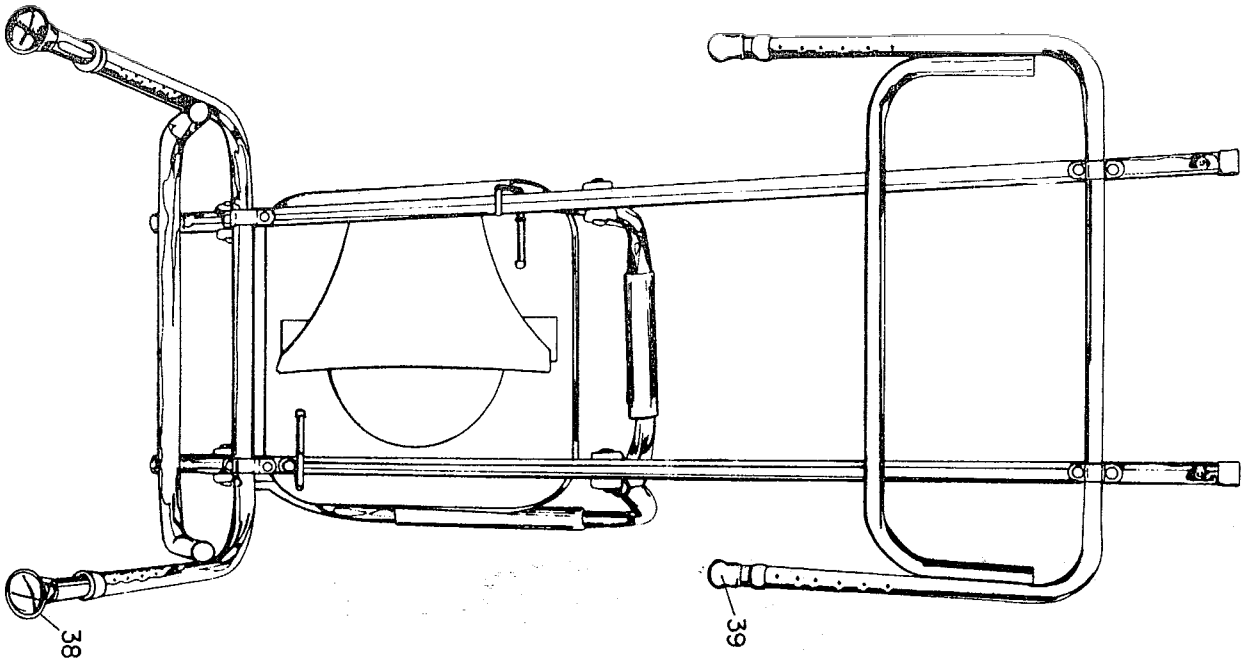
FIG. 6 illustrates the manner in which the legs can be collapsed for storage.

FIGS. 2A–3B illustrate the preferred embodiment of the invention when the legs 18 are securely locked in the vertical position by locking brace 22. For ease of storage the bench 14 may be readily collapsed by unscrewing wing nuts 26, removing bolts 24 and folding the U-shaped leg elements 20 up against tubular tracks 16 as shown in FIG. 6. In this manner the bench 14 may be knocked down and stored or shipped in a package only a few inches high.

Chair 12 includes a seat 44, a pair of side arms 46, a back 48, and four plastic rollers 50 which ride on tubular tracks 16. Rollers 52 have an hour-glass shape including a concave portion 52 which is roughly complementary to the contour of tubular tracks 16. Nylon ® or any other similar plastic material can be used to form rollers 50. Nylon ® is a registered trademark of the E. I. DuPont Company of Wilmington, Delaware. Chair 12 is formed on a tubular steel frame 54. The rollers 50 are attached to the tubular steel frame 54 by brackets 56 and axel rods 58 which passes through the center of rollers 50. For added comfort and convenience each of the sidearms 46 includes a rubberized padded tubular arm rest cushion 60. Similarly a tubular backrest cushion 62 is attached to back 48. The tubular elements which comprise chair frame 54 can be welded or riveted together in a conventional manner.

Chair seat 44 is preferably padded and covered with a washable vinyl-like fabric 64. The interior of seat 44 typically includes a rigid wooden base covered by a suitable cushioning material. Screws 66 pass through holes on the underside of tubular frame 54 and are employed to fasten the seat 44 to frame 54. Seat 44 includes an aperture 68 therein which passes from top to bottom. Aperture 68 has roughly the same dimensions as the corresponding aperture on a conventional toilet seat. The purpose of aperture 68 is to provide comfort, drainage and access to the underside of the patient.

Figure 4A:
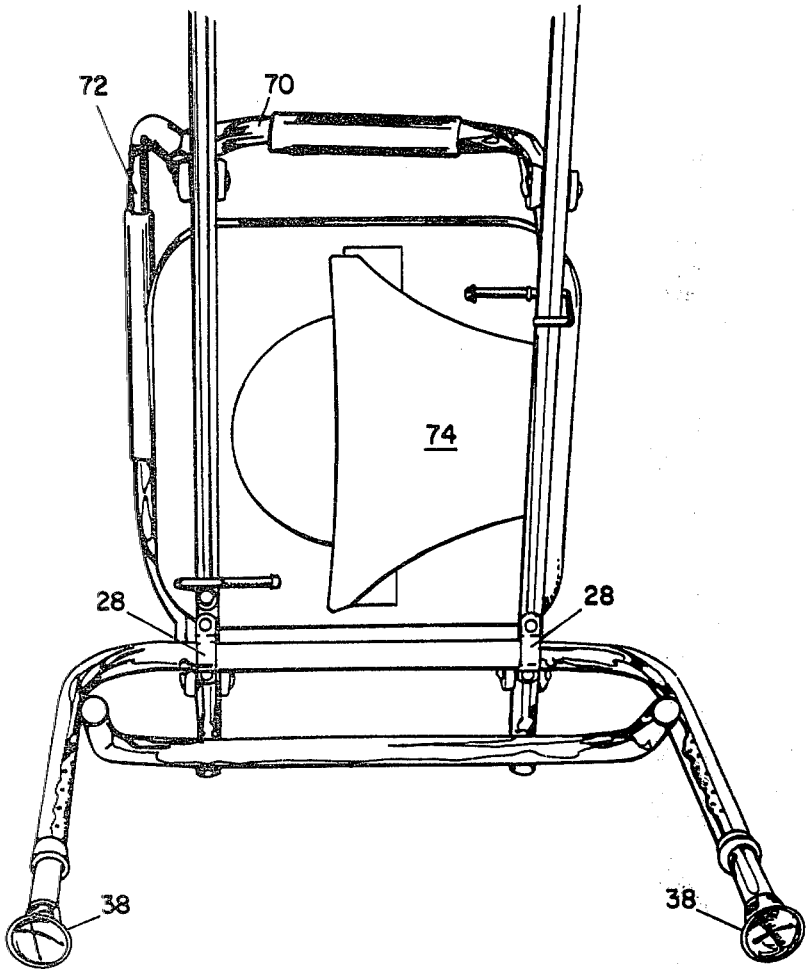
FIG. 4A is a detailed view showing the legs locked in the full open position and the genital guard in place.
Figure 4B:
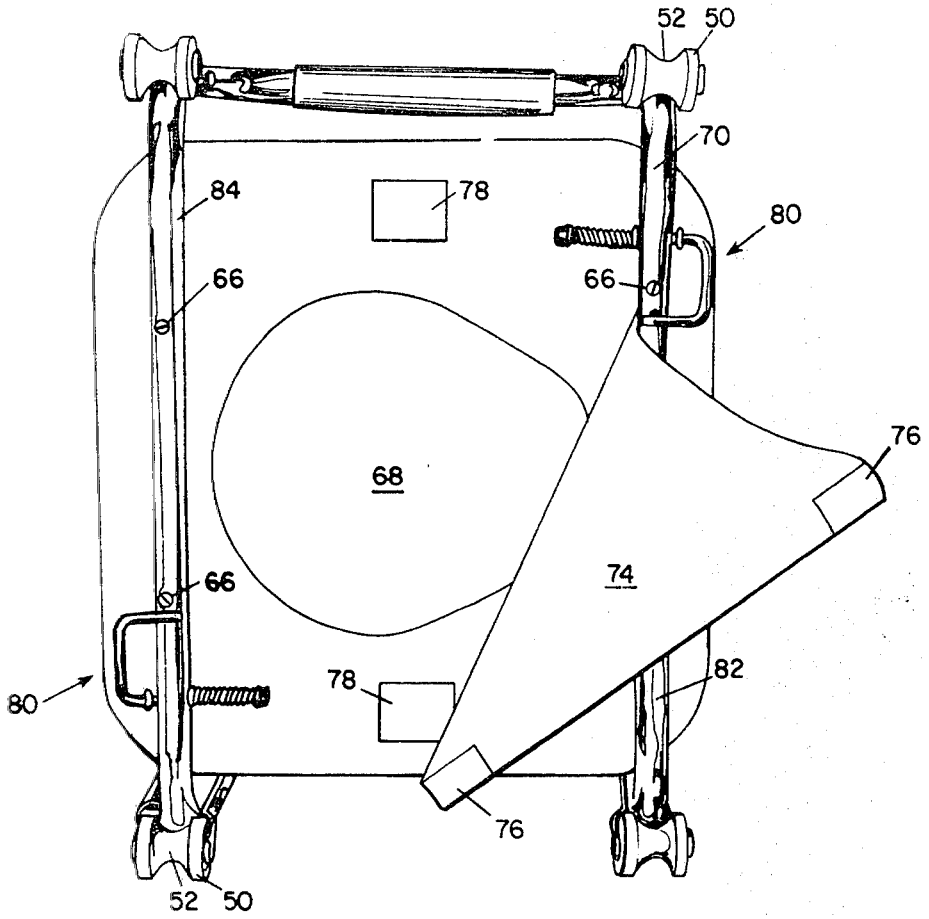
FIG. 4B is a detailed view showing the gential guard partially released.
Figure 5:
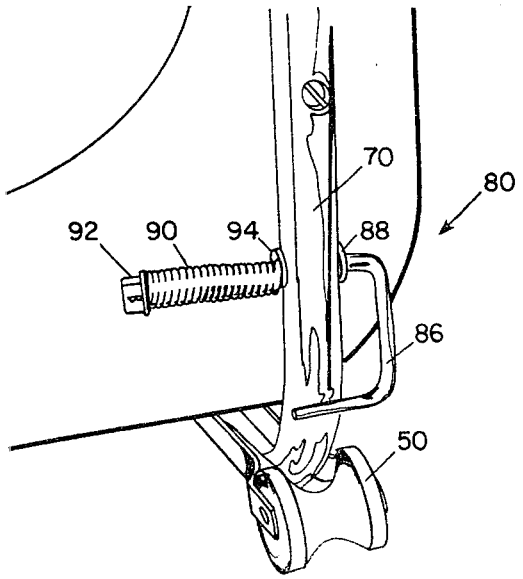
FIG. 5 is a detailed view showing the safety hook mechanism.

FIGS. 4A–5 illustrate details of the bottom structure of Chair 12. It will be initially appreciated that the tubular chair frame 54 comprises two elements. The first element is a substantially continuous and closed portion 70 which includes both side arms 46 and the tubular structure under the seat 44. The back 48 comprises a second tubular frame element 72 which is attached to the arm frame element 70 in a conventional manner. FIGS. 4A and 4B illustrate the manner in which a genital guard 74 is connected to the underside of seat 44. Genital guard 74 preferably comprises a washable fabric having a generally trapezoidal shape. The short edge of the trapezoid is securely attached to the front tubular element 82 of tubular arm frame 70. The corners of the long side of the genital guard 74 include releasable fasteners 76 which are adapted to mate with fastener elements 78 firmly attached to the underside of seat 44. According the the preferred embodiment of the invention fasteners 76 and 78 may be male and female Velcro ® elements. Fasteners 76 and 78 mate securely by pressing the two portions together. The genital guard can be released by tearing fasteners 76 and 78 apart in the conventional manner.

Each chair comes equipped with two spring-loaded safety hooks 80. Details of a typical safety hook 80 can be appreciated by referring to FIG. 5. Generally one safety hook is located on the front tubular element 82 and positioned near one corner of seat 44. The other safety hook 80 is located diagonally across the seat 44 and attached to the back tubular seat element 84. Elements 82 and 84 are integral parts of the arm and seat of tubular arm frame 70 which in turn comprises part of the tubular steel frame 54 of the chair 12. Each safety hook 80 includes a generally J-shaped hook element 86, a stop portion 88, a spring 90, and a cap 92. The long shaft portion of each J-shaped hook element 86 passes through an appropriate hole or bushing 94 in tubular seat elements 82 or 86 in the manner illustrated in FIG. 5. Spring 90 passes over the shaft of hook element 86 and is held in compression against either tubular element 82 or 84 by cap 92 which has a width greater than the diameter of spring 90. A stop element 88 such as a washer may be welded to hook element 86 and is located on the opposite side of tubular element 82 or 84 from the spring 90. In this manner the spring 90 is always kept in compression thereby tending to draw the tips of the J-shaped hook element 86 inwardly toward the center of the seat 44. The purpose of spring-loaded safety hooks 80 is to loosely engage tracks 16 as shown in FIG. 4A so that chair 12 does not tip forward or backward. Chair 12 can be reversed by drawing back on both safety hooks 80 and thereby disengaging them from tubular tracks 16, rotating the chair by 180° and re-engaging both safety hooks 80 with tracks 16.

In use the chair is initially located outside of the tub as illustrated in FIG. 2A. If the patient is a male the genital guard 74 is connected in place as illustrated in FIG. 4A. The patient then pushes himself or is pushed across the edge of the tub until the seat is in the position in FIG. 2B. At that location it is possible to draw the shower curtain across the track 16 so as to give the patient some privacy.

Figure 3A:
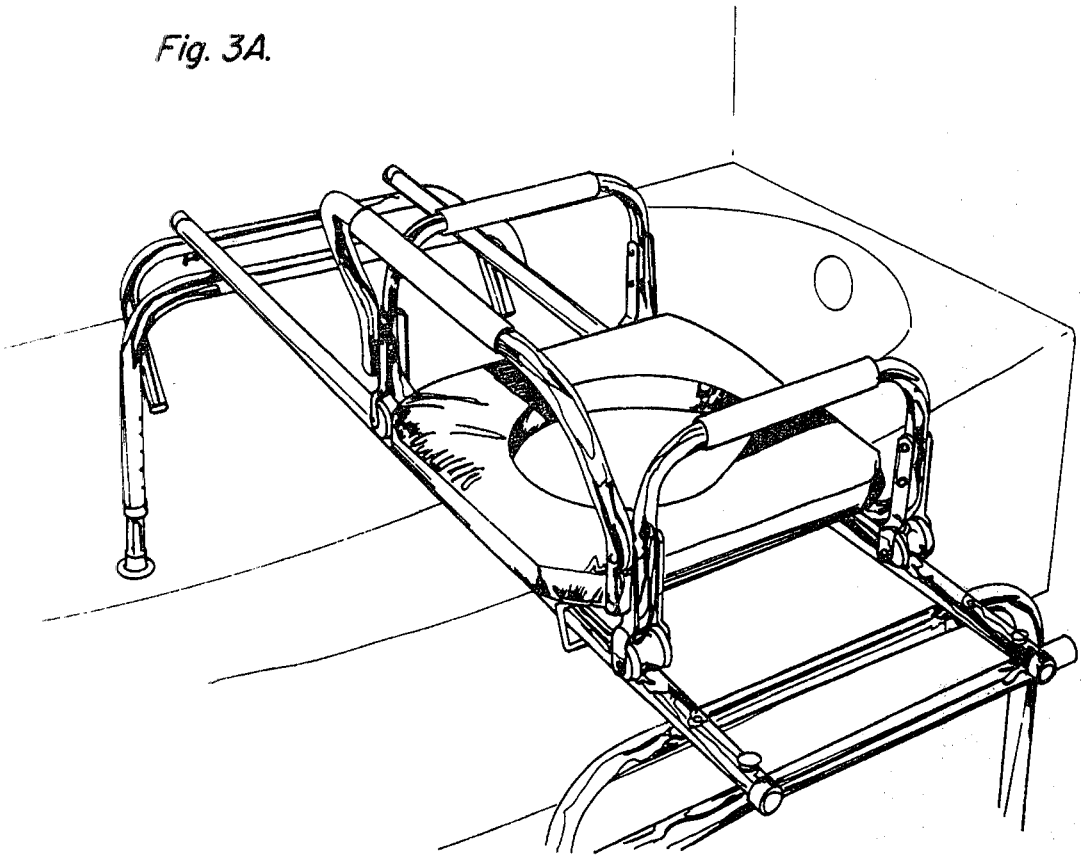
FIG. 3A is a perspective view of the preferred embodiment of the invention showing the chair rotated by 180° and located on the outside of the bathtub.
Figure 3B:
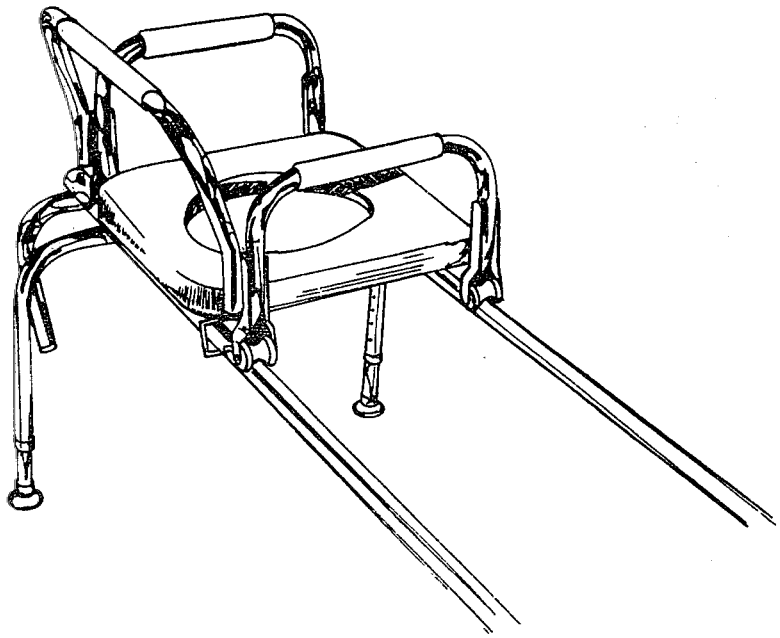
FIG. 3B is a perspective view of the invention illustrated in FIG. 3A with the seat shown transferred to the inside of the bathtub.

FIG. 3A shows the chair 12 reversed by 180° in the manner previously described. FIG. 3B shows the same chair transferred to the inside of a typical tub.

The transfer bench according to the preferred embodiment may be easily assembled and installed. First, the equipment, if packed, is unpacked, and the legs 18 are unfolded so that locking brace 22 fits into the indentations 25 in tracks 16 adapted to receive locking brace 22. Next thumbscrews 24 are placed through the apertures in tracks 16 and locking braces 22 and secured with wing nuts 26. The legs 18 with suction tips 28 attached are then placed inside the tub as close to the far inside wall as possible. Seat assembly 12 is mounted by placing rollers 50 on track 16. Spring-loaded safety hooks 80 are then rotated until they engage loosely around tracks 16. The height of the transfer bench 10 is adjusted to be most comfortable for the patient. The dual set of adjustment holes 34 on each leg 18 permits the height of the bench to be adjusted in ½" increments. In order to prevent water from dripping onto the floor it may be desirable to make two slits in the shower curtain so that it may be draped inside the bathtub on either side of tracks 16.

While the invention has been described with reference to a preferred embodiment thereof, it will be appreciated by those of ordinary skill in the art that various different changes may be made in the structure and function of the parts without departing from the spirit and scope of the invention.

I claim:

1. A transfer bench apparatus comprising:

a chair;

at least four roller means attached to the underside of said chair;

a bench including track means comprising at least two substantially parallel and substantially equally long tubular tracks for supporting said roller means attached to said chair, said two tracks defining a space therebetween, said bench further including leg means for supporting said track means; and, releasable means attached to said chair for loosely engaging at least one of said tubular tracks thereby preventing said chair from falling off of said bench, wherein said chair faces away from the space between said two tubular tracks and wherein said releasable means can be disengaged from at least one of said tubular tracks thereby completely disengaging said chair from said bench and allowing said chair to be rotated by 180° in a plane parallel to said tubular tracks and re-engaged with said tubular tracks facing in the opposite direction from its previous engagement.

2. The apparatus of claim 1 further including:

locking means for locking said leg means in an unfolded mode; and, pivot means for pivoting said leg means into said track means so that said bench can be stored.

3. The apparatus of claim 2 wherein said leg means comprises two U-shaped members each respectively located at opposite ends of said track means and connected by said pivot means thereto.

4. The apparatus of claim 3 wherein said releasable means comprises at least one releasable hook means including:

a J-shaped element slidably attached to said chair for engaging at least one of said tubular tracks; and, a spring means attached to said chair and to said J-shaped element for biasing said J-shaped element into engagement against at least one of said tubular tracks and allowing said J-shaped element to be disengaged from one of said tubular tracks.

5. The apparatus of claim 4 further including:

at least two releasable hook means attached to said chair for selectively engaging and disengaging said two tubular tracks respectively so that one of said hook means can engage one of said two tubular tracks and the other of said hook means can engage the other of said two tubular tracks.

6. The apparatus of claim 5 wherein said locking means comprises:

a U-shaped brace pivotally connected to each of said U-shaped leg members respectively; and, attachment means for selectively attaching a portion of said brace to said tracks.

7. The apparatus of claim 6 wherein said roller means comprises plastic elements having an hourglass like shape which partially surround the top side of said tracks when in use.

8. The apparatus of claim 7 wherein said chair comprises:

a seat portion having an opening therein;

a back; and, a pair of arm means.

9. The apparatus of claim 8 further including:

a genital guard connected across the seat of said chair.

10. The apparatus of claim 9 wherein said genital guard comprises:

a fabric material connected at one portion thereof to the underside of said seat; and, a pair of releasable fasteners for temporarily fastening said genital guard to said seat.

11. The apparatus of claim 10 further including:

suction cup means attached to said leg means.

12. The apparatus of claim 11 further including:

means for adjusting the height of said leg means.

* * * * *